US005931339A

United States Patent [19]

Dodge et al.

[11] Patent Number: 5,931,339

[45] **Date of Patent: *Aug. 3, 1999**

[54] PROCESS AND APPARATUS FOR DISPENSING PAPER TOWELS

[75] Inventors: Bernard E. Dodge, Palatka, Fla.; John S. Formon, Marietta, Ga.

[73] Assignee: Georgia-Pacific Corporation, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/659,214

[22] Filed: Jun. 5, 1996

[51] Int. Cl.[6] ..... A47K 10/24

[52] U.S. Cl. ..... 221/45; 221/63

[58] Field of Search ..... 221/48, 63, 45, 221/49, 56, 59; 206/449, 494

[56] References Cited

U.S. PATENT DOCUMENTS

| | | | |
|---|---|---|---|
| 1,989,381 | 1/1935 | Samson | 221/56 |
| 2,033,582 | 3/1936 | Materno | 206/57 |
| 2,323,395 | 7/1943 | Harwood | 206/57 |
| 2,730,267 | 1/1956 | Marcalus | 221/48 |
| 2,858,045 | 10/1958 | Loeb | 221/59 |
| 3,161,336 | 12/1964 | Loescher | 225/106 |
| 3,203,586 | 8/1965 | Downham | 221/55 |
| 3,272,385 | 9/1966 | Watkins | 221/48 |
| 3,349,959 | 10/1967 | Watkins | 221/48 |
| 4,411,374 | 10/1983 | Hotchkis | 221/63 |
| 4,623,074 | 11/1986 | Dearwester | 221/63 |
| 5,332,118 | 7/1994 | Muckenfuhs | 221/48 |

FOREIGN PATENT DOCUMENTS

| | | | |
|---|---|---|---|
| 0 331 027 | 9/1989 | European Pat. Off. . | |
| 336986 | 3/1904 | France . | |
| 1537127 | 7/1968 | France . | |
| 2362610 | 3/1978 | France . | |
| 187873 | 8/1991 | Japan | 221/56 |

*Primary Examiner*—Kenneth Noland
*Attorney, Agent, or Firm*—Banner & Witcoff, Ltd.

[57] ABSTRACT

A dispenser for individually dispensing paper towels from a stack of interfolded paper towels. The paper towels are received in a housing and dispensed by their ends through a slot in a smooth and generally uninterrupted manner. The slot is formed with a narrow medial portion and enlarged end portions to release only one paper towel at a time. Moreover, the dispenser effectively resists a user pulling a bunch of paper towels from the dispenser.

16 Claims, 7 Drawing Sheets

PROCESS AND APPARATUS FOR DISPENSING PAPER TOWELS

FIELD OF THE INVENTION

The present invention pertains to a process and apparatus for dispensing paper towels, and particularly to dispensing a stack of interfolded paper towels. For this application, the term "paper towel" is intended to broadly cover all sheet paper products designed to dry or clean surfaces including, for example, napkins and tissues as well as other items generally referred to as paper towels.

BACKGROUND OF THE INVENTION

Individual paper towels are frequently dispensed from a stack of interfolded or C-fold paper towels. The paper towels can have a single-fold or multifold construction. A single-fold paper towel is formed from a rectangular sheet which has one fold line extending generally parallel to the two side edges of the sheet. The fold line subdivides the sheet into two sections which are usually of equal size. The two sections of the sheet are each generally on the order of eleven inches by five inches. When stacked, the sections of each paper towel are superposed and adapted to receive therebetween one section from each of the two adjacent towels. The fold lines of the two adjacent paper towels are opposed to the fold line of the first towel. Further, the two adjacent towels will each receive one section of the first towel between their overlapping sections.

One form of multifold paper towel is interfolded in a stack much like a single fold paper towel. These towels include a plurality of fold lines to define a multiple of overlapping sections arranged in an accordion style. In a stack, one section of each paper towel is received between a pair of sections of each adjacent paper towel. Another form of multifold paper towel is the C-fold paper towel. A C-fold paper towel is formed from a single sheet and folded to have a generally C-shaped configuration. While the towels are stacked for dispensing, they are not interfolded together.

A stack of paper towels is generally dispensed from an enclosed bin provided with an elongate opening along its bottom surface. One section of the bottommost paper towel protrudes from the opening to be grasped and dispensed by a user. In an interfolded stack, pulling a paper towel from the bin will cause the lower section of the next paper towel to protrude from the opening. In a stack of C-fold towels, a flap of the next towel is exposed for grasping after the bottommost towel is removed. However, in either case, multiple towels are occasionally dispensed when the bottommost towel is pulled out of the opening. The risk of dispensing multiple towels is particularly acute when the stack is low, and less weight and friction are available to hold the remaining towels in the bin.

Interfolded paper towels may also be dispensed from an opening in the top of an enclosed box. In essentially the same way, pulling the uppermost paper towel out of the box causes one section of the next paper towel to protrude from the opening. However, as the stack becomes smaller, a larger and larger gap is formed between the opening and the top of the stack. A plastic element is often used in an effort to prevent the adjacent paper towels from becoming disconnected. Nevertheless, disconnection does frequently occur to disrupt the dispensing process. When this happens, the user must reach through the opening and pull the next paper towel from the box.

Finally, many dispensers are susceptible to people purposefully removing an excessive number of paper towels, and thereby causing waste and loss for the owner. One such dispenser is formed as a box with an open front such that the front paper towel is held along its peripheral edge. The stack is oriented horizontally and spring biased forwardly toward the opening. With this construction, a user can push a finger into the dispenser, against the bias of the spring, and pull out a bunch of the paper towels.

SUMMARY OF THE INVENTION

In accordance with the present invention, paper towels are individually dispensed from a stack of interfolded paper towels. The paper towels are received in a housing and dispensed by their ends through a slot in a smooth and generally uninterrupted manner. The slot is formed to release only one paper towel at a time. Moreover, the dispenser effectively resists a user pulling a bunch of paper towels from the dispenser.

DETAILED DESCRIPTION OF PRESENT INVENTION

Figure 6:
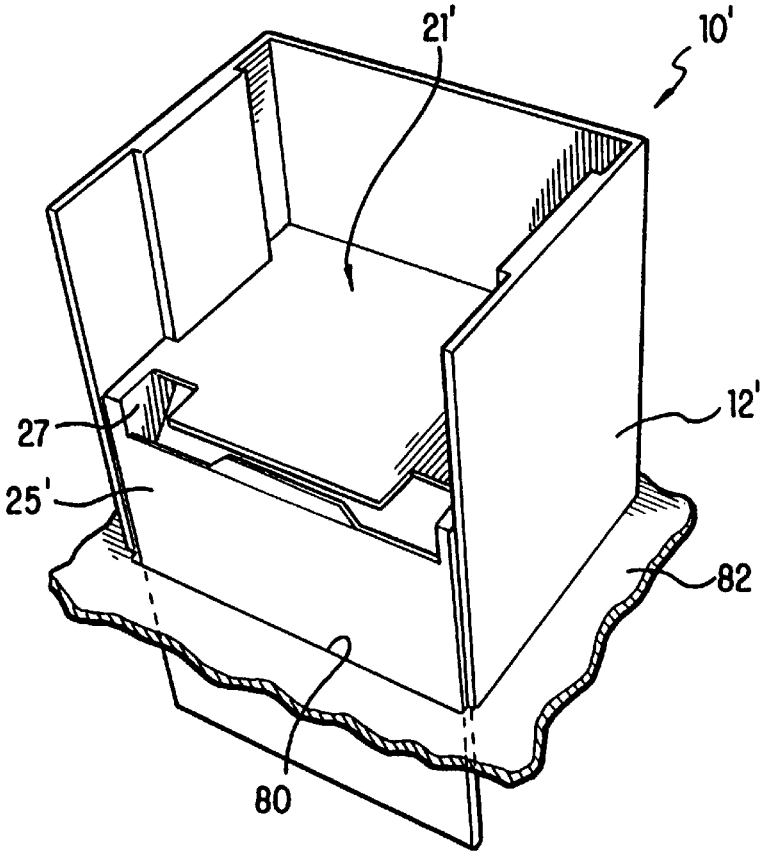
FIG. 6 is a perspective view of a second dispenser in accordance with the present invention.

A dispenser 10 (FIGS. 1–5) in accordance with the present invention has a housing 12 with a rear wall 14, bottom wall 16, and a pair of side walls 17, 18, which collectively define an inner cavity 19 into which a stack of paper towels 20 is placed. A dispensing element 21 is slidably mounted for vertical movement in cavity 19. Dispensing element 21 has a top face 23 which overlies the stack of paper towels 20, a front face 25, and a pair of side braces 27 (seen only in the modified embodiment of FIG. 6). Top face 23 include notches 29 along its sides to receive guideways 31 mounted along the inner surfaces of side walls 17, 18. Of course, other guiding arrangements could be used.

Figure 1:
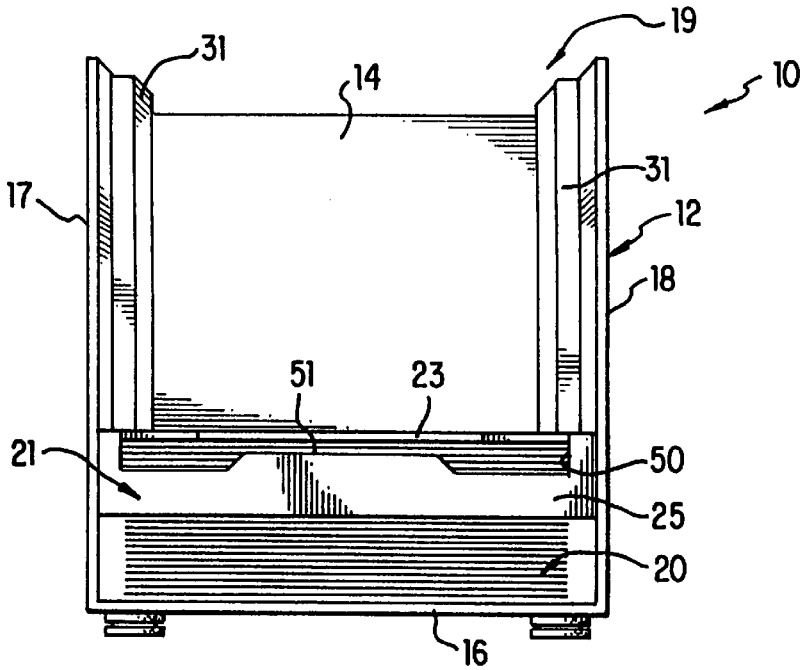
FIG. 1 is a front view of a dispenser in accordance with the present invention.
Figure 12:
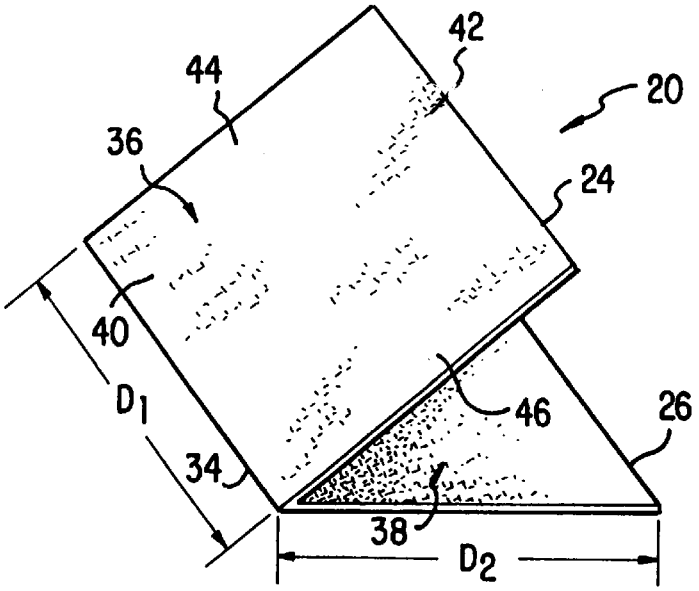
FIG. 12 is a top plan view of a partially folded, single-fold paper towel.
Figure 13:
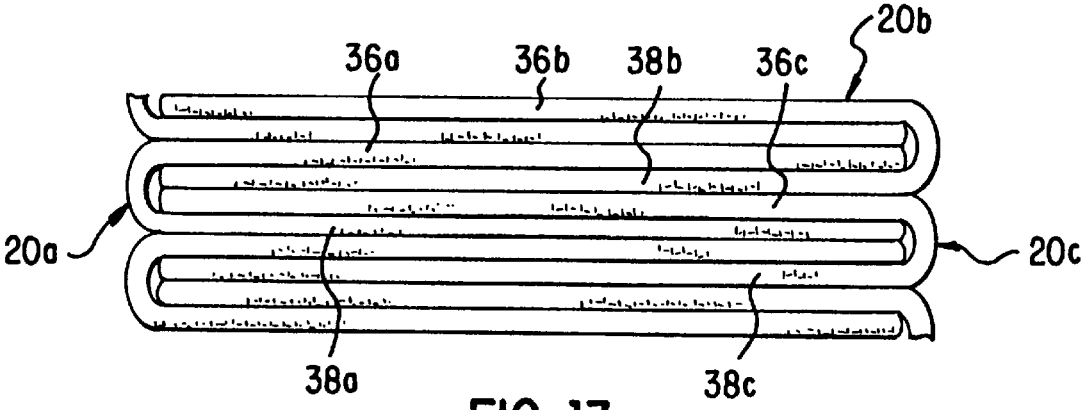
FIG. 13 is an enlarged, partial end elevational view of a stack of single-fold paper towels.

The paper towels 20 are loaded into housing 12 in an interfolded stack (FIGS. 1 and 13). Paper towels 20 are preferably single-fold towels, although multifold towels may also be used. A single-fold paper towel 20 (FIGS. 12 and 13) is formed of a single sheet 22 of material having two opposite side edges 24, 26, and two opposite end edges 28, 30. Sheet 22 includes a fold line 34 extending parallel to side edges 24, 26, preferably along the midpoint of the sheet; although, if desired, the fold line could be off center. Fold line 34 defines two equal sections or layers 36, 38. The folded towel 20 (i.e., with sections 36,38 superposed) includes a fold side 40, an edge side 42, and a pair of ends 44, 46.

The stacked paper towels 20 are interfolded with one another (FIG. 13). For example, paper towels 20*a*, 20*b*, 20*c* are folded in the stack such that sections 34, 36 of each towel are superposed. Towel 20*a* receives one section 36*b*, 34*c* from the two adjacent towels 20*b*, 20*c* between its two sections 34*a*, 36*a*. Fold lines 34*b*, 34*c* are positioned on the opposite side of the stack from fold line 34*a*. Section 34*a* is then received between sections 34*b*, 36*b* of paper towel 20*b*, and section 36*a* is received between sections 34*c*, 36*c* of paper towel 20*c*. The stack is loaded into housing 12 such that the ends 44 (or 46) of the paper towels 20 face front wall 25 of dispensing element 21.

Paper towels 20 are dispensed through a slot 50 extending transversely across front face 25 of dispensing element 21 (FIGS. 1 and 3–5). Slot 50 lies adjacent top face 23 in order to dispense the uppermost paper towel of the stack. The lower edge 51 of slot 50 is contoured so as to define a narrow medial portion 52, a pair of enlarged end portions 54, 56, and transition portions 58, 60. In particular, lower edge 51 includes generally horizontal end segments 62, 63, a generally horizontal medial segment 68 offset from the end segments, and inclined transition segments 65, 66 interconnecting the end and medial segments. In one preferred example, the height $H_1$ of medial portion 52 is 0.250 inches and the height $H_2$ of end portions 54, 56 is 0.500 inches. Further, in this example end segments 62, 63, transition segments 65, 66, and medial segment 68 are 1.375 inches, 0.353 inches, and 2.500 inches, respectively. The lengths of the different segments may of course be varied. Also, the dimensions of the slot may vary depending upon the size, bulk and weight of the paper.

Figure 2:
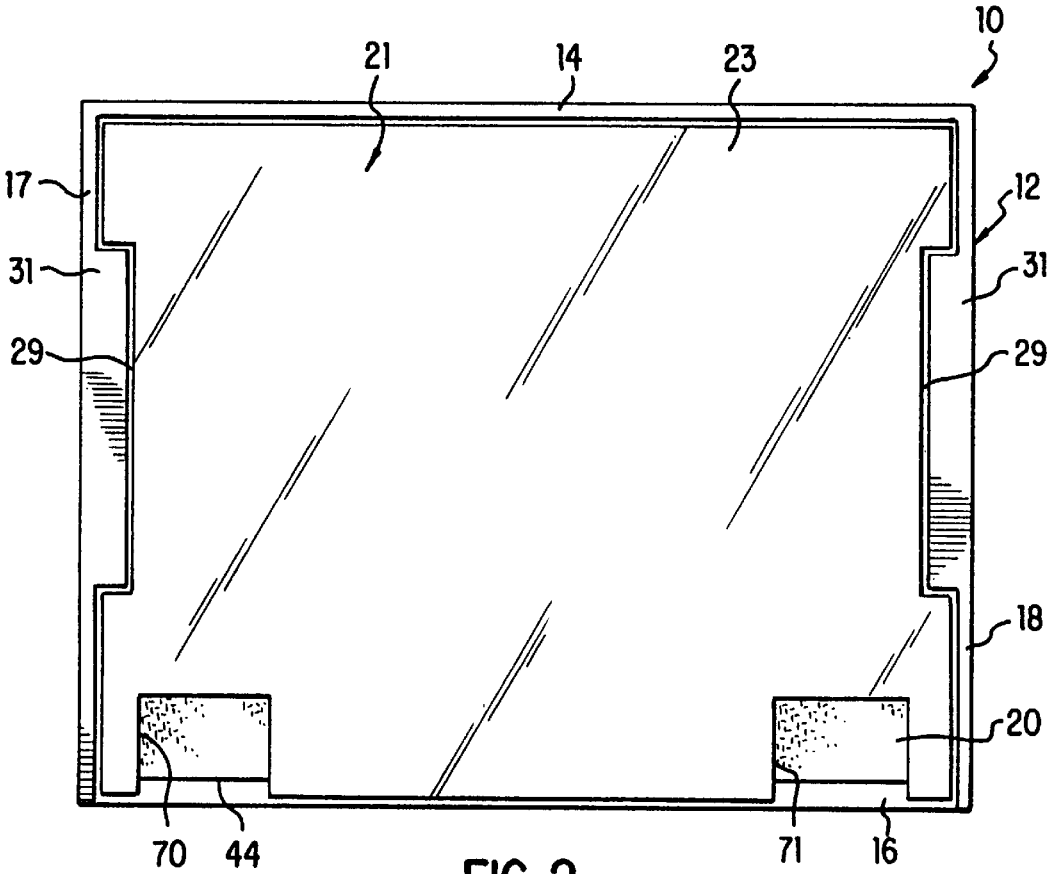
FIG. 2 is a top plan view of the dispenser.
Figure 3:
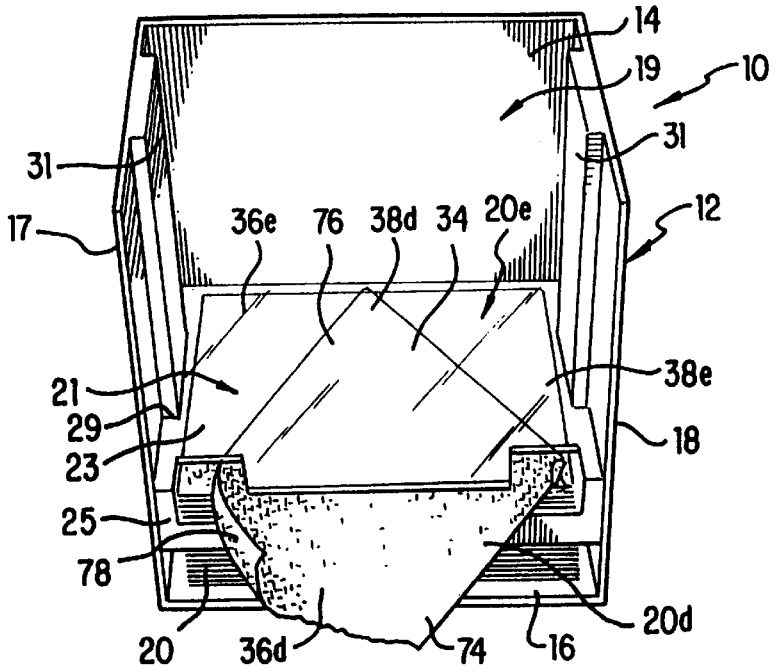
FIG. 3 is a front view of the dispenser with a paper towel partially dispensed.
Figure 4:
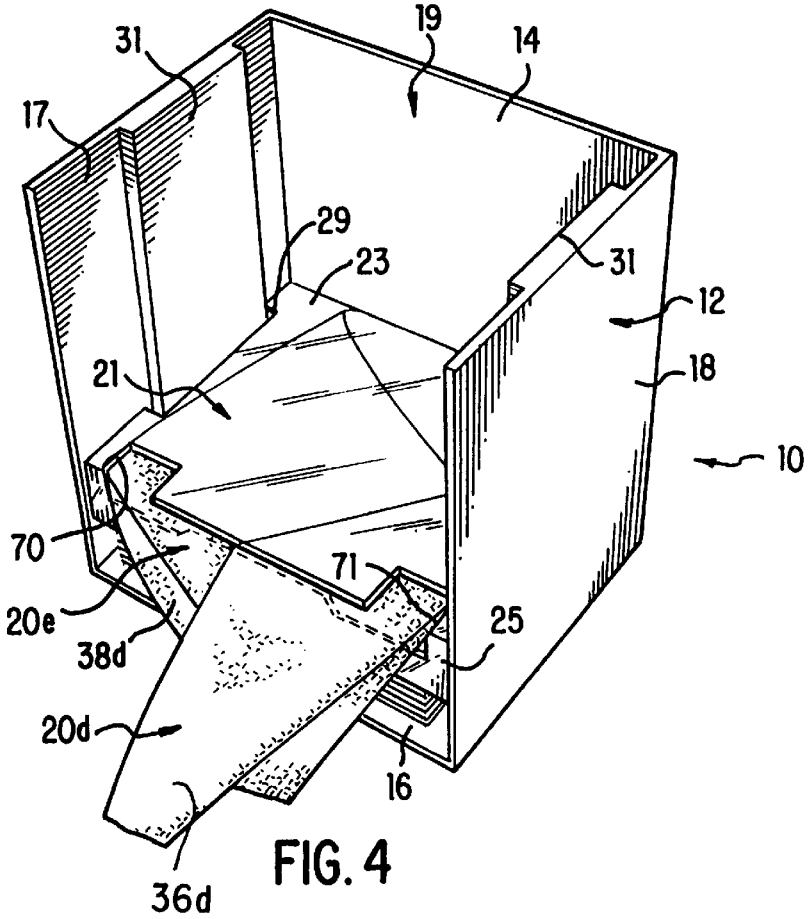
FIG. 4 is a perspective view of the dispenser with a paper towel which is further dispensed.
Figure 5:
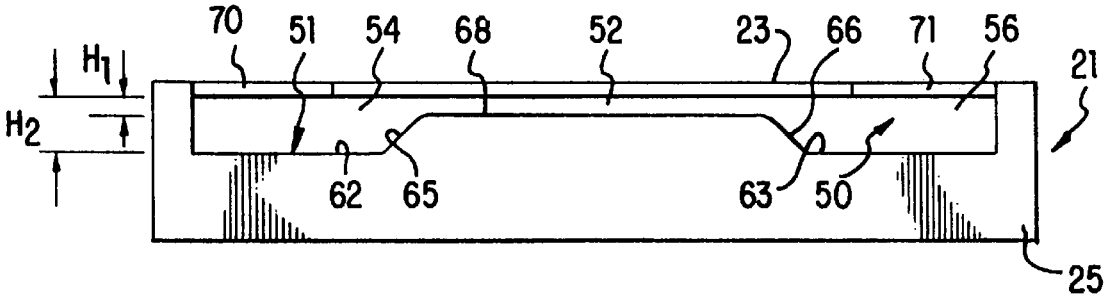
FIG. 5 is a front, elevational view of a dispensing element of the dispenser.

To begin dispensing the paper towels 20, a user pulls the uppermost paper towel 20 from slot 50. To aid in starting the dispensing process, cutouts 70, 71 are provided in top face 23 adjacent end portions 54, 56 (FIGS. 2–4). In this way, the user can reach into one of the cutouts 70, 71 and pull out the first paper towel 20. Once the first towel is removed, the remaining towels will be successively pulled partially out of the slot 50 with the removal of each towel.

The stack of paper towels is placed in housing 12 with the ends 44 (or 46) facing front face 25. As seen in FIG. 3, dispenser 10 has a paper towel 20*d* partially removed from the stack. Paper towel 20*d* is initially removed primarily through end portion 54. Generally, corner 74 along edge side 42 of section 36 is grasped and pulled by a user. This pulling action tends to cause section 36 to shift in a rotative type movement as the section is pulled through slot 50; although significant variability of the towel's movement during dispensing can occur. The diagonally opposed corner 76 tends to move toward the far side wall 17 and thereby gradually pull the fold line 34 along with it. This action, in turn, rolls the lower section 38 up against top face 23 as paper towel 20*d* is removed. Paper towel 20*d* is also being slid outward through slot 50 while it is being rolled and rotatively shifted.

To ensure that corners 76, 78 clear side wall 17, the width to depth ratio of the paper towel 20 should be limited. For paper towel having a basis weight of about 23–25 pounds, the width to depth ratio of the paper towel should not be more than about 1:1.1 (FIG. 12); that is, the distance $D_1$ from end to end (i.e., 40 to 42) should be no more than about ten percent longer than the distance $D_2$ from side to side (i.e., 44 to 46). Accordingly, if a paper towel has a width (i.e., side to side) of 5 inches, then its depth (i.e., end to end) should not be more than about 5.5 inches. With regard to lighter weight paper, the width to depth ratio can be larger than 1:1.1; that is, the paper towels can be formed with a larger depth $D_1$ as compared to the width $D_2$. The depths of the paper towel can, however, be smaller than the maximum limits. Towels which are significantly deeper than the maximum aspect ratio for a given paper risk being jammed as they are dispensed, which can lead to ripping or excessive crinkling of the towel.

As the paper towel begins to dispense out slot 50, the bulk of the initial portion of the towel usually pulls through one of the end portions 54 or 56 (FIG. 3). As the pulling continues, the paper towel extends across the remainder of the slot. Medial portion 52 is narrowed to prevent more than one towel from being dispensed when the lead towel is pulled by the user. The intersection of transition segments 65, 66 with medial segment 68 are rounded to avoid catching or ripping the paper towel being dispensed.

As the paper towels are removed from dispenser 10, dispensing element 21 slides downward along guideways 31. In this way, dispensing element 21 continually rests on the uppermost paper towel. This application of weight on the towels maintains sufficient frictional forces between the interfolded paper towels so that one section 36 of the next paper towel is partially pulled out with the removal of the uppermost paper towel.

More specifically, as the bottom section 38*d* of the uppermost paper towel is rolled over and slid toward slot 50, top section 36*e* of the next paper towel 20*e* is rolled over and slid with it. This concurrent movement of the two towels continues essentially until the overlying sections begin passing through slot 50. At this point, the narrowed medial portion 52 and transition portions 58, 60, and the frictional contact with the underlying paper towel sections, tends to resist the concurrent movement of the two towel sections. Paper towel 20*d* therefore begins to slide relative to towel 20*e* so that only a portion of the next towel extends outside of slot 50 when towel 20*d* has been completely removed (FIG. 4). As can be appreciated, the next towel 20*e* will be dispensed in the same way as towel 20*d*, except that the movement will be in the opposite direction due to the towels being interfolded in an alternating manner.

To load the dispenser, dispensing element 21 is lifted or removed from housing 12 and the paper towels are inserted. In this embodiment, the front and top of housing 12 are open to facilitate loading of the paper towels. Nevertheless, a top wall or stop may be provided along the top of the housing to prevent removal and possible loss of dispensing element 21. Since the lower paper towels are exposed when the housing is loaded, this embodiment is susceptible to a user digging into the stack and removing a bunch of the towels. Accordingly, this embodiment is especially suited for use by employees, such as by a check out clerk to wipe the scanner at a grocery store.

In an alternative embodiment (FIG. 6), the front face 25' of dispensing element 21' may be extended to completely cover the front of the housing 12' when fully loaded to prevent users from pulling out a bunch of towels from the middle or bottom of the stack. This dispenser 10', of course, would need to be mounted on the edge of a counter or provided with an opening 80 in the counter 82 to receive the extended front face 25'. The use of an opening 80 in the counter would ordinarily be used when the dispenser 10' is built integrally into the counter top.

In another dispenser 110 (FIGS. 7–10), which is preferred for any usage, a housing 112 is provided with a top wall 113, front wall 115, bottom wall 116, and a pair of side walls 117, 118 to define a cavity 119 for receiving paper towels 20. A slot 150 is provided in front wall 115 adjacent bottom wall 116 for dispensing the paper towels. As with the earlier embodiments, the paper towels are arranged such that their ends 44 (or 46) face front wall 115. Slot 150 has the same configuration as slot 50, except that it is inverted; that is, the contoured edge 151 is along the upper edge of the slot instead of the lower edge. The dispensing operation is the same, except that it also is reversed. The lower section 38 of the bottommost paper towel 20 is grasped and pulled by the user. Further the upper section 36 rolls over and slides along bottom wall 116 as the towel is pulled out.

Figure 7:
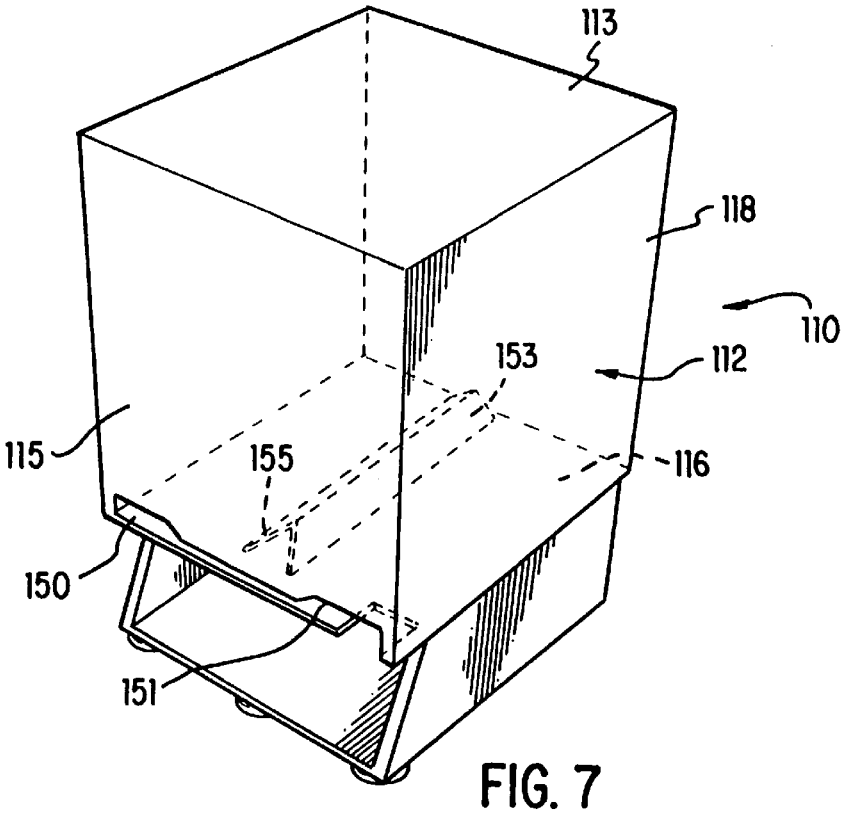
FIG. 7 is a perspective view of a third dispenser in accordance with the present invention.
Figure 8:
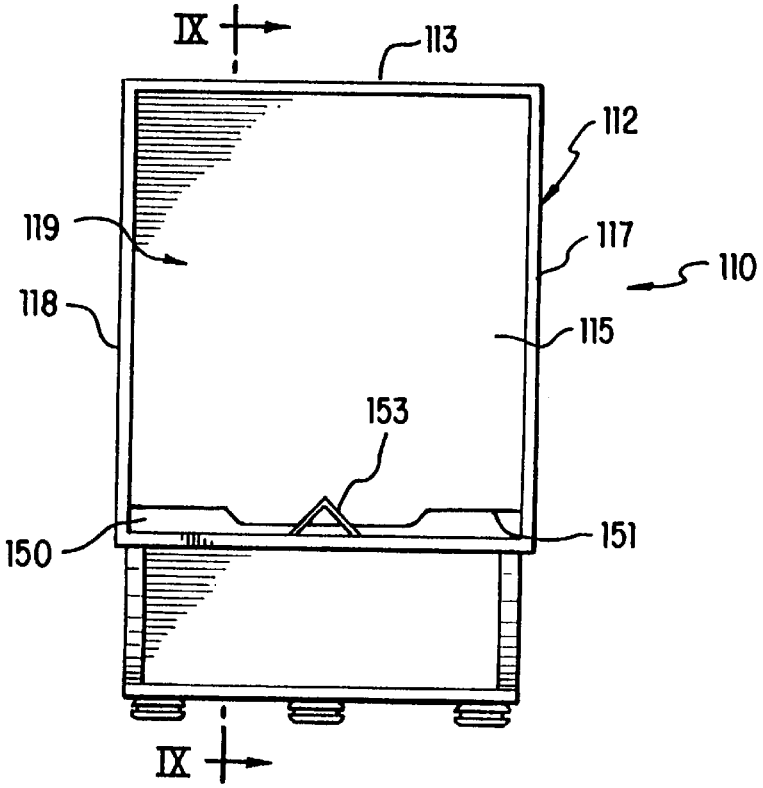
FIG. 8 is a rear, elevational view of the third dispenser.
Figure 9:
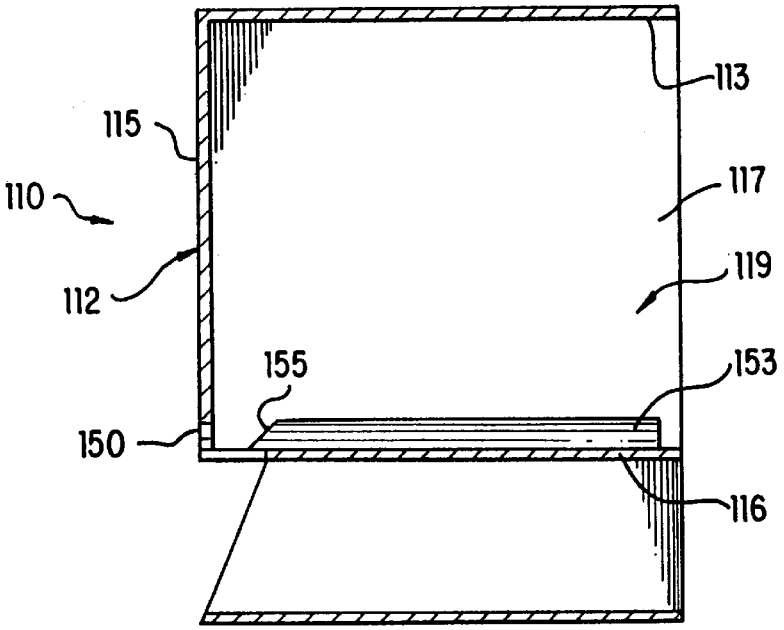
FIG. 9 is a cross-sectional view taken along line IX—IX of FIG. 8.
Figure 10:
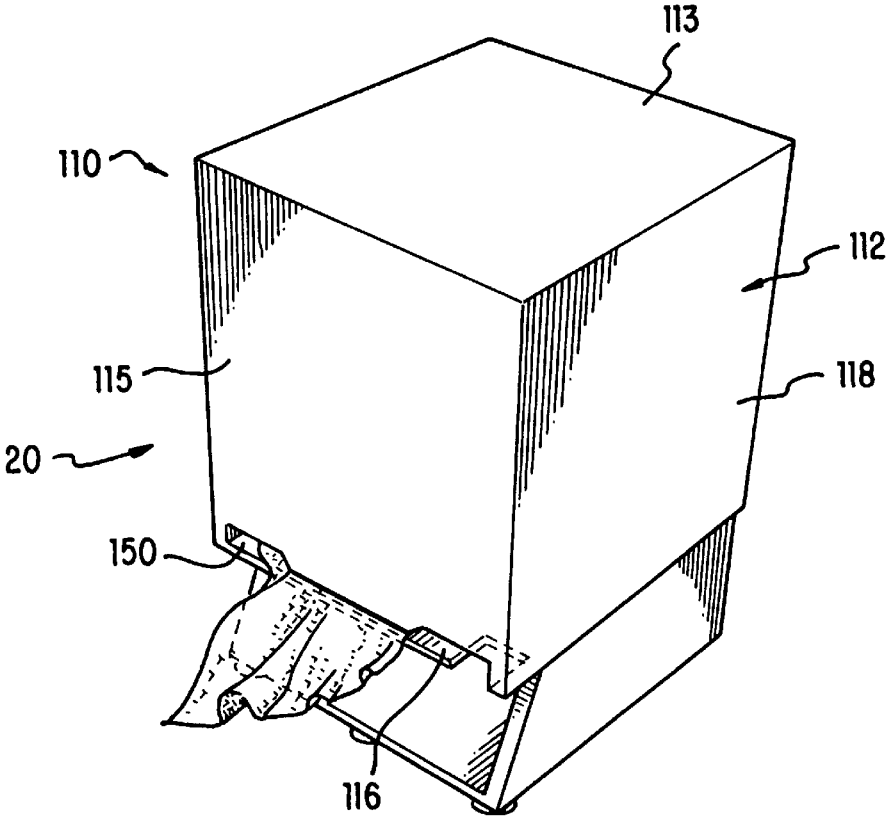
FIG. 10 is a perspective view of the third dispenser with a partially dispensed paper towel.
Figure 11:
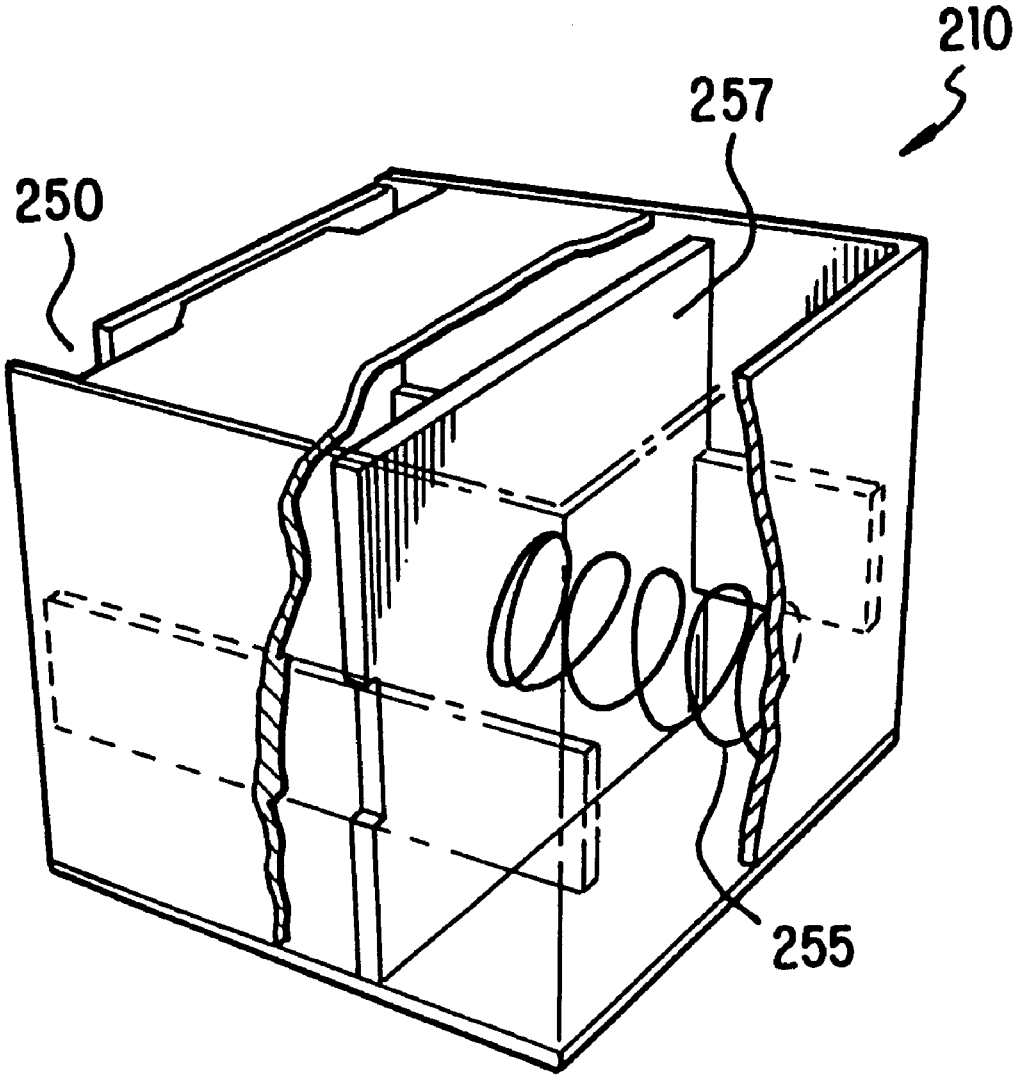
FIG. 11 is a partially broken, perspective view of a fourth dispenser in accordance with the present invention.

A rail 153 is mounted along bottom wall 116 to accommodate the additional weight of the stack on the towel being dispensed in dispenser 110 (FIGS. 7–9). Rail 153 is centrally mounted on bottom wall 116 to extend from front to back. Rail 153 preferably has a triangular configuration, although other shapes, such as semi-circular, could be used. Rail 153 causes the bottom portion of the stack to be bowed over the rail. In this embodiment, the stack tends to shift or rock slightly about rail 153 as the alternating paper towels are removed from the dispenser. To enable the paper towels to be dispensed smoothly, rail 153 is spaced from front wall 115. In the preferred example, rail 153 is spaced 0.500 inches from front wall 115 and provided with a sloped front end 155 inclined at an angle of about 45 degrees.

The rear side of housing 112 is preferably left open to provide for easy loading of the paper towels 20 (FIGS. 8 and 9). Nevertheless, a rear wall or hinged rear door (not shown) could be used to provide a closed container. Of course, a door for loading paper towels could be provided along any of the walls of the housing. The door could also be provided with a locking mechanism of known construction, if desired.

Dispenser construction 10 or 110, could also be oriented horizontally rather than vertically. In this arrangement, slot 50 or 150 could be oriented upward, downward or along a side of the dispenser. As an example, dispenser 210 receives a horizontal stack of paper towels 20. The stack is biased to advance the towels toward slot 250 by spring 255. Spring 255 presses on plate 257 which, in turn, presses on the last paper towel in the stack to be dispensed. Alternatively, the dispenser 210 could be placed on an incline and a weight used to bias the paper towels toward the slot 250. Also, when a dispensing element is used (not shown), the spring biases the dispensing element toward the stack.

The above discussion concerns the preferred embodiments of the present invention. Various other embodiments as well as many changes and alterations may be made without departing from the spirit and broader aspects of the invention as defined in the claims.

We claim:

1. A dispenser for paper towels comprising a housing with a cavity having a certain width for receiving a stack of interfolded paper towels and a slot in said housing having a length and a width through which said paper towels are individually dispensed from said housing, said length of said slot being about the same as the width of said cavity, said slot having a pair of end portions at each end of said length of said slot and a medial portion between said end portions, said medial portion having a smaller dimension across the width than each of said end portions.

2. A dispenser in accordance with claim 1 in which said medial portion of said slot is dimensioned to prevent the dispensing of more than one paper towel at a time.

3. A dispenser in accordance with claim 1 in which said housing supports said stack of paper towels in a generally vertical stack.

4. A dispenser in accordance with claim 1 in which said housing supports said stack of paper towels in a generally horizontal stack.

5. A dispenser in accordance with claim 1 in which said slot is formed in a wall of said housing.

6. A dispenser in accordance with claim 1, wherein said slot further has an edge along one side including a pair of spaced end segments, a medial segment between but offset from said end segments, and a pair of transition segments interconnecting said end segments and said medial segments.

7. A dispenser in accordance with claim 6 in which said segments are each generally linear.

8. A dispenser in accordance with claim 7 in which said segments generally lie in the same plane.

9. A dispenser for paper towels comprising a housing for receiving a stack of interfolded paper towels in a generally horizontal stack, a slot through which said paper towels are individually dispensed from said housing, said slot having a medial portion and a pair of end portions, said medial portion defining a narrower gap than said end portions, and means for biasing said slot and an end of the stack toward one another.

10. A dispenser in accordance with claim 9 in which said slot is formed in a wall of said housing and said biasing means moves said stack toward said slot as the paper towels are dispensed.

11. A dispenser in accordance with claim 9 in which said slot is formed in a dispensing element slidably mounted within said housing, and said biasing means moves said dispensing element toward said stack as said paper towels are dispensed.

12. A dispenser for paper towels comprising a housing for receiving a stack of interfolded paper towels and a slot through which said paper towels are individually dispensed from said housing, said slot having a medial portion and a pair of end portions, said medial portion defining a narrower gap than said end portions, and said slot being formed in a dispensing element slidably mounted to said housing to move relative to said housing as the paper towels are dispensed.

13. A dispenser for paper towels comprising a housing for receiving a stack of paper towels, said housing including a base surface extending generally parallel to the paper towels and abutting against one end of the stack, and a front wall which extends generally perpendicular to said base surface, wherein said front wall has a slot for dispensing the paper towels, said slot has a medial portion and a pair of end portions, and said medial portion defines a narrower gap than said end portions.

14. A dispenser in accordance with claim 13 in which said base surface and said front wall are integrally formed with said housing.

15. A dispenser comprising a housing for receiving a stack of paper towels, said housing including a base surface extending generally parallel to the paper towels and abutting against one end of the stack, and a front wall which extends generally perpendicular to said base surface, wherein said front wall has a slot adjacent said base surface for dispensing the paper towels, and said base surface and said front wall form at least part of a dispensing element which is slidably mounted to said housing so as to move relative to the housing as the paper towels are dispensed.

16. A dispenser comprising a stack of paper towels and a housing for receiving the stack of paper towels, said housing including a base surface extending generally parallel to the paper towels and abutting against one end of the stack, a front wall extending generally perpendicular to said base surface, and a slot adjacent said base surface having a length and width for dispensing individual paper towels from the housing, said slot being oriented in said front wall such that the length of the slot is generally parallel to said base surface.

* * * * *